US005230477A

United States Patent [19]

Strohmeyer

[11] Patent Number: 5,230,477

[45] Date of Patent: Jul. 27, 1993

[54] KNIFE SHAFT STRIPPING DEVICE FOR DOCUMENT SHREDDERS

[75] Inventor: Willi Strohmeyer, Hanover, Fed. Rep. of Germany

[73] Assignee: PBS-Servicegesellschaft mbH & Co. KG, Hanover, Fed. Rep. of Germany

[21] Appl. No.: 650,710

[22] Filed: Feb. 4, 1991

[30] Foreign Application Priority Data

Feb. 3, 1990 [DE] Fed. Rep. of Germany ..... 4003222

[51] Int. Cl.[5] ..... B02C 18/16

[52] U.S. Cl. ..... 241/166; 241/236

[58] Field of Search ..... 83/114; 241/236, 166, 241/167, 285 R

[56] References Cited

U.S. PATENT DOCUMENTS

| | | | |
|---|---|---|---|
| 3,033,064 | 5/1962 | Lee | 83/114 |
| 4,257,565 | 3/1981 | Hatanaka | 241/236 X |
| 4,545,537 | 10/1985 | Kimura et al. | 241/236 X |
| 4,997,134 | 3/1991 | MacGregor | 241/236 X |
| 5,071,080 | 12/1991 | Herbst et al. | 241/166 |

FOREIGN PATENT DOCUMENTS

| | | | |
|---|---|---|---|
| 0010681 | 5/1980 | European Pat. Off. | 241/236 |
| 1511166 | 7/1969 | Fed. Rep. of Germany | 241/236 |
| 3616554 | 11/1987 | Fed. Rep. of Germany . | |
| 4003222 | 4/1991 | Fed. Rep. of Germany . | |
| 1403624 | 11/1965 | France . | |
| 1321580 | 6/1973 | United Kingdom . | |
| 2096919 | 10/1982 | United Kingdom | 241/236 |

*Primary Examiner*—Mark Rosenbaum
*Assistant Examiner*—Frances Chin
*Attorney, Agent, or Firm*—Foley & Lardner

[57] ABSTRACT

A knife shaft stripping device is described, in which the stripping fingers (5) are made of plastic and are injection molded in one piece either with a housing top (7) or with a housing bottom (8), and in which supporting stays (6) are associated with the stripping fingers (5), which likewise are made of plastic and injection molded in one piece with the mating housing bottom (8) or housing top (7). Bearing surfaces (12) for the knife shafts (3) are also disposed in the housing top (7) and in the housing bottom (8), and the stripping fingers (5) and supporting stays (6) are provided with abutment surfaces (9, 10) which contact one another when the cutting mechanism (2) is assembled such that the stripping fingers (5) are supported.

9 Claims, 3 Drawing Sheets

KNIFE SHAFT STRIPPING DEVICE FOR DOCUMENT SHREDDERS

BACKGROUND OF THE INVENTION

This invention relates to a knife shaft stripping device for a document shredder having integrally formed stripping fingers disposed between the knives of the knife shafts in the cutting area of its cutting mechanism.

The stripping fingers of such stripping devices in the cutting mechanisms prevent the shredded material from penetrating between the knives of the knife shafts and clogging them. Shredded material clogging the space between the knives of the knife shafts would lead to difficulties in operation.

German Published Application No. DE-OS 36 16 554 discloses the idea of arranging integrally constructed stripping fingers in the form of stripping grids in a cutting mechanism. The stripping grids are attached to the side members of the cutting mechanism which also contain the bearings for the knife shafts.

SUMMARY OF THE INVENTION

It is the object of the invention to provide a document shredder with a simplified construction.

Another object of the invention is to provide a document shredder with a reduced number of component parts.

These and other objects of the invention are achieved by providing a knife shaft stripping device for a document shredder including a cutting mechanism comprising a plurality of knife shafts equipped with document shredding knives arranged along a paper path in a housing comprising a housing top and a housing bottom, the stripping device comprising a plurality of integrally formed, plastic stripping fingers disposed between the knives of the knife shafts in a cutting zone in the cutting mechanism, the stripping fingers being injection-molded in one piece with one of the housing top and the housing bottom; the stripping device further comprising a plurality of plastic support stays associated with the stripping fingers, the support stays likewise being injection molded in one piece with the other of the housing top and the housing bottom, the housing top and housing bottom having bearing surfaces formed therein for the knife shafts, and the stripping fingers and support stays having abutment surfaces formed thereon which contact one another when the document shredder is assembled such that the support stays support the stripping fingers.

A simpler construction of the document shredder is achieved by the fact that the stripping fingers are made of plastic and are injection molded in one piece with either the top or the bottom of the housing, the stripping fingers are associated with support stays which are likewise made of plastic and are injection molded in one piece with the opposite part of the housing, while bearing surfaces for the knife shafts are disposed in both the top and the bottom of the housing, and the stripping fingers and the support stays are provided with abutment surfaces which engage one another when the cutting mechanism is assembled in such a way that the stripping fingers are supported. In this manner it is possible to reduce the manufacturing cost of the component parts, and the assembly costs are also reduced.

Surprisingly, it has been found that it is possible to injection-mold the stripping fingers from plastic, as long as support stays are arranged to give the stripping fingers the necessary support and stability.

According to a preferred embodiment of the invention the knife shaft stripping device is configured such that the stripping fingers are injection molded in one piece with the top part of the housing, and, being arrayed comb-wise, they project downward between the knives of the knife shafts, and also such that the support stays are injection molded in one piece with the bottom part of the housing. The top part of the housing bearing the comb-like stripping fingers thus can be installed in a final operation after the installation of the knife shafts. Preferably the support stays are disposed underneath the knife shafts, so as to form a support for the abutment surfaces of the stripping fingers. This solution is especially advantageous from the injection molding point of view. The abutment surfaces of the stripping fingers are advantageously disposed at the sides of the backing rails that face the paper passing through the shredder. This prevents the moving paper from pressing the stripping fingers against the knife shaft, which would result in operational difficulties.

The support stays provide optimal support due to the fact that their abutment surfaces for the stripping fingers on the sides facing the paper path and also at the top faces of the support stays are arranged at an angle to one another, and due to the fact that the abutment surfaces of the stripping fingers are configured such that these surfaces will contact one another when the cutting mechanism is assembled. In this way a precise alignment of the stripping fingers parallel to the knife shafts is achieved. Furthermore, the cooperation of the stripping fingers with the support stays also has the effect of reinforcing or stiffening the housing top member.

Inasmuch as the abutment surfaces are arranged at an acute angle or an obtuse angle to one another, the result is a mating junction assuring a precise alignment of the stripping fingers in all directions in which forces are exerted.

An especially advantageous embodiment of the invention is achieved if a mount for the motor and bearing surfaces for its transmission gears are additionally disposed in the housing top and in the housing bottom. Such a mount and/or the bearing surfaces can be formed integrally with the housing parts in a simple manner by injection molding.

BRIEF DESCRIPTION OF THE DRAWINGS

The invention will be explained in further detail with reference to an illustrative preferred embodiment depicted in the accompanying drawings in which.

DETAILED DESCRIPTION OF PREFERRED EMBODIMENTS

Figure 1:
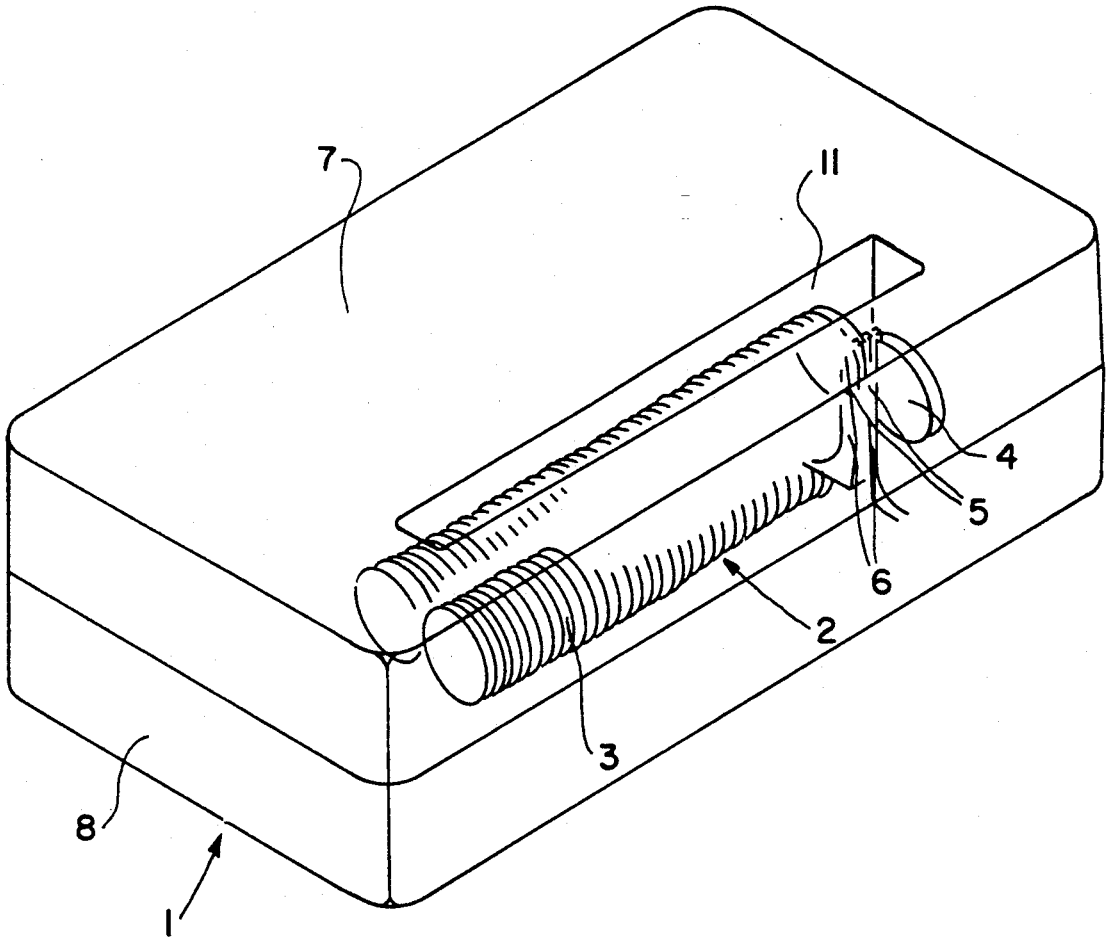
FIG. 1 shows a document shredder whose knife shaft stripper can be seen in perspective.

FIG. 1 shows a document shredder 1 in which a cutting mechanism 2 is disposed. The cutting mechanism 2 comprises two knife shafts 3 on which intermeshing knives 4 are disposed in a known manner for shredding documents. A knife shaft stripping device comprising of two rows of stripping fingers 5 and support stays 6 is disposed adjacent both knife shafts 3. As it can be seen in FIG. 1 of the drawing, the stripping fingers 5 project into and fill the intervening spaces between the knives 4 of the knife shafts 3. In this way, entry of shredded paper into these intervening spaces is prevented.

Figure 2:
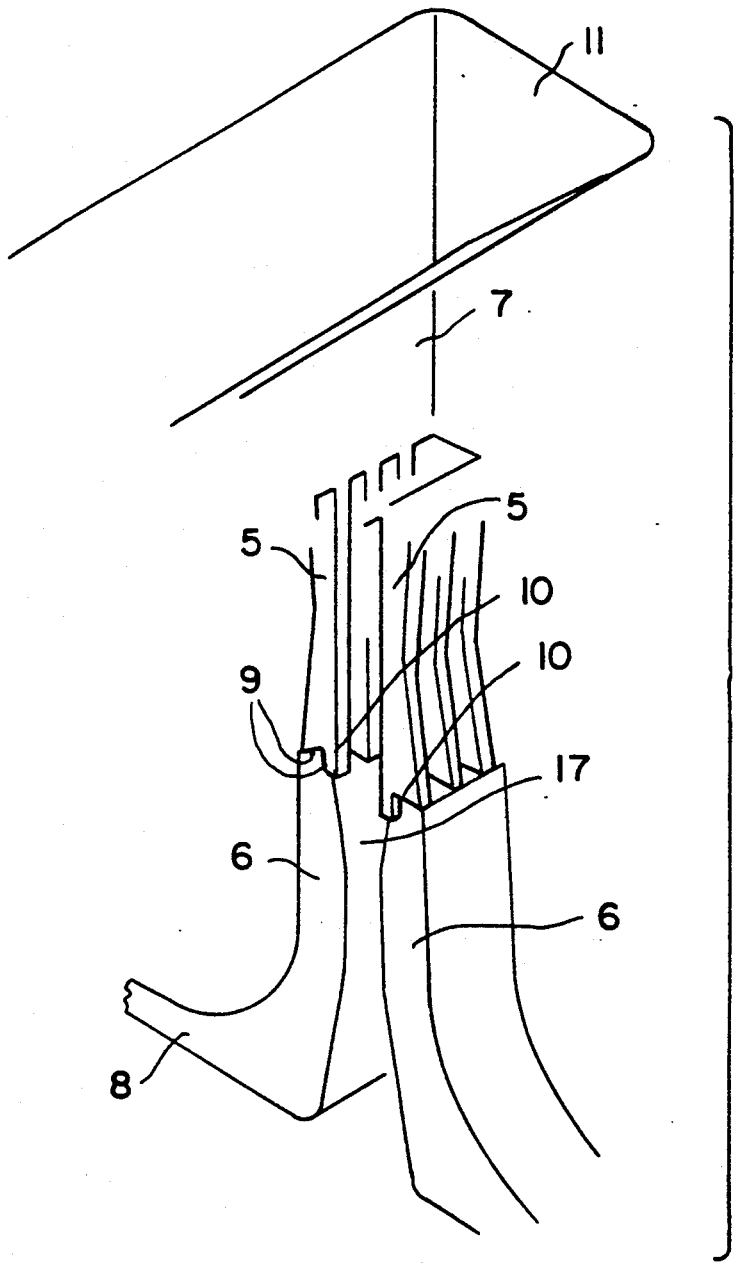
FIG. 2 is an enlarged perspective view of the knife shaft stripper of FIG. 1.

The stripping fingers 5 have a comb-like configuration and are injection-molded integrally in one piece with the housing top member 7. The support stays 6 are injection-molded in one piece with a housing bottom member 8, as can be seen especially in FIG. 3. The support stays 6 have continuous abutment surfaces 9 which, as can be seen especially in FIG. 2, are arranged at an angle to one another. Mating abutment surfaces 10 are disposed on the stripping fingers 5. When the cutting mechanism 2 is assembled, i.e., when the housing top 7 is placed on the housing bottom 8, the abutment surfaces 9 and 10 contact each other. As can be seen from FIG. 2, the abutment surfaces 9 of the stripping fingers 5 mate with the abutment surfaces 10 such that the stripping fingers are supported by the support stay 6 not only in both lateral directions but also vertically. This not only prevents any lateral displacement of the stripping fingers 5 by the paper, but also any displacement perpendicular to the longitudinal axes of the knife shafts in the direction of paper movement 3.

It can also be seen from that drawing that a paper entry chute 11 is provided in the housing top 7 for guiding the paper to be shredded. Bearing surfaces 12 for the knife shafts 3 are arranged in the housing bottom member 8. These bearing surfaces 12 are injection-molded in the housing bottom 8 and in the housing top 7 the same as the stripping fingers 5 and the support stay 6. The same applies to a mount 13 for a motor 14 for document shredder 1. Bearing surfaces 15 for transmission gears 16 are also injection-molded into the housing top 7 and housing bottom 8. Motor 14 drives the knife shafts 3 via the transmission 16.

Paper, not shown in the drawing, is shredded by introducing it into the paper entry chute 11 and passing it to the knives 4 of the knife shafts 3. The overlapping knives 4 shred the paper, while the stripping fingers 5 prevent paper from getting into the intervening spaces between the knives 4. The shredded paper then passes through a paper channel 17 formed between the stripping fingers 5 and the support stays 6 disposed on either side, and drops into a receptacle, also not shown in the drawing. Since the stripping fingers 5 are supported by the support stays 6, they are held in their position in spite of being constructed as inherently flexible plastic parts. As it has surprisingly been found, this construction according to the invention assures that the stripping fingers 5 remain in their position during the shredding operation. The forces exerted by the paper being shredded are insufficient to deform the stripping fingers 5 enough to disturb the shredding operation. The advantages described above stem from forming the stripping fingers 5 and the support stays 6 as plastic parts.

In an alternate embodiment it is possible to lengthen the stripping fingers 5 and to provide the support stays 6 in the form of ridges on the housing bottom 8, for example. The important thing is that the support surfaces 10 are disposed on the housing bottom 8.

Furthermore, it is, of course, also possible to injection-mold the stripping fingers 5 on the housing bottom 8. In this case, the support stays 6 are disposed on the housing top member 7. Such a construction is also fully capable of achieving the advantages of the invention.

Figure 3:
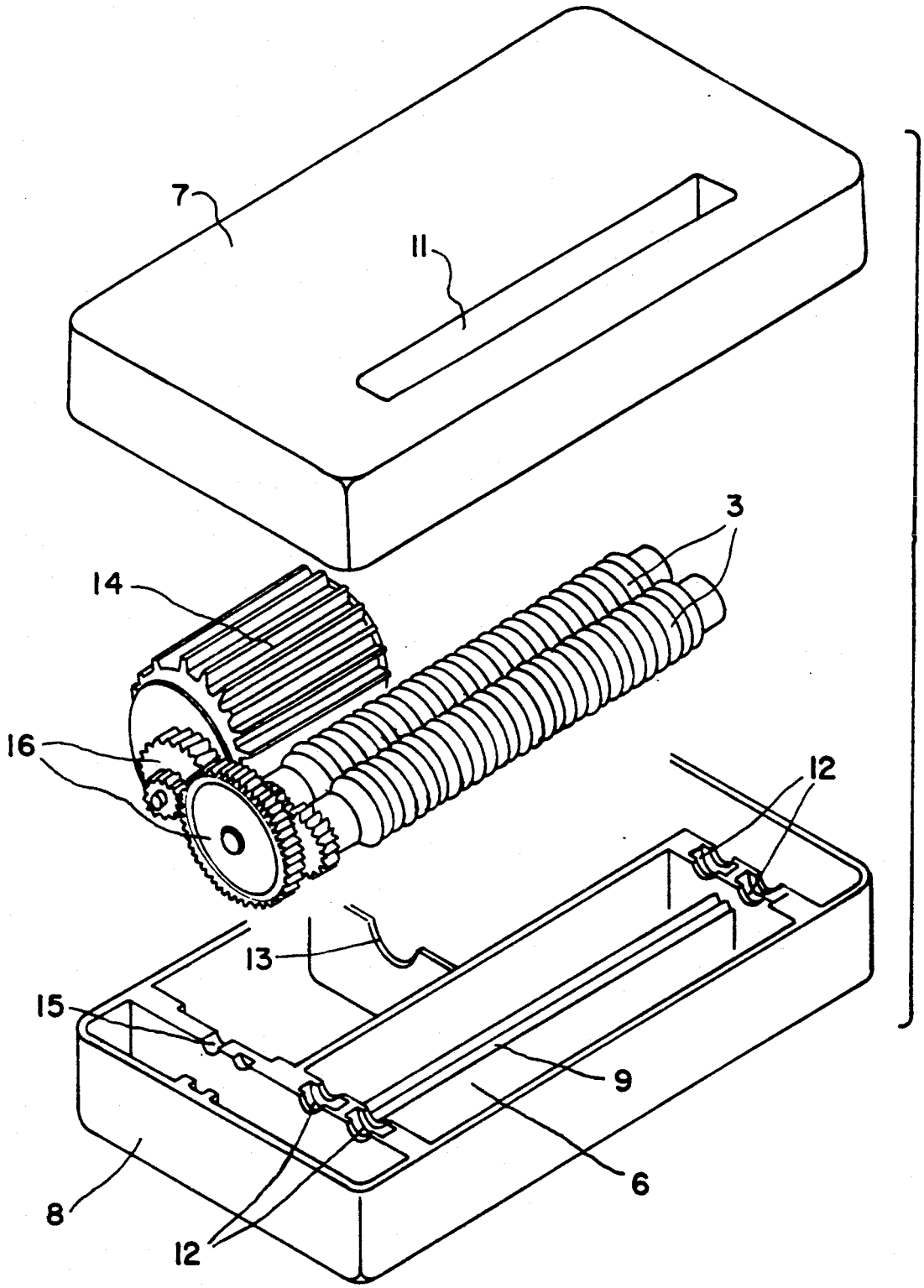
FIG. 3 shows an exploded representation of the document shredder of FIG. 1.

As is apparent from FIG. 3, the components of the document shredder 1 are very easy to assemble if constructed in accordance with the invention. According to an especially advantageous embodiment, it is ultimately only necessary to place the components in the housing bottom 8 containing the support stays 6, the bearing surfaces 12 for the knife shafts 3, the mount 13 for the motor 14, and the bearing surfaces 15 for the transmission 16, and then to place the housing top member 7 with the stripping fingers 5 on top of the housing bottom 8. The alignment and fixing of the stripping fingers 5 on the surfaces 10 of the support stays 6 occur automatically. Also, the component costs are low, since the housing top 7 and the housing bottom 8 are each injection-molded in a single piece.

The foregoing description and example have been set forth merely to illustrate the invention and are not intended to be limiting. Since modifications of the described embodiments incorporating the spirit and substance of the invention may occur to persons skilled in the art, the invention should be construed broadly to include all variations falling within the scope of the appended claims and equivalents thereof.

What is claimed is:

1. In combination with a cutting mechanism comprising a plurality of knife shafts equipped with document shredding knives arranged along a paper path in a housing comprising a housing top and a housing bottom, a stripping device comprising a plurality of integrally formed, plastic striping fingers disposed between the knives of the knife shafts in a cutting zone in the cutting mechanism, said stripping fingers being injection-molded in one piece with one of said housing top and said housing bottom; said stripping device further comprising a pair of elongated plastic support stays extending parallel to the knife shafts of the cutting mechanism and being associated with said stripping fingers, said support stays likewise being injection molded in one piece with the other of said housing top and said housing bottom, said housing top and housing bottom having bearing surfaces formed therein for said knife shafts, and said stripping fingers and support stays having abutment surfaces formed thereon which contact one another when said document shredder is assembled such that each of the support stays supports a row of the stripping fingers.

2. A knife shaft stripping device according to claim 1, wherein said stripping fingers are injection-molded integrally with the housing top, and said supporting stays are injection-molded integrally with the housing bottom.

3. A knife shaft stripping device according to claim 2, wherein said stripping fingers have a comb-like configuration and project downwardly between the knives of the knife shafts.

4. A knife shaft stripping device according to claim 2, wherein said support stays are arranged underneath said knife shafts.

5. A knife shaft stripping device according to claim 1, wherein said abutment surfaces for said stripping fingers are disposed on the sides of the support stays facing the paper path.

6. A knife shaft stripping device according to claim 1, wherein said abutment surfaces for said stripping fingers on the sides facing said paper path and on the faces of said support stays are disposed at an angle to one another, and the abutment surfaces of said stripping fingers are correspondingly arranged such that when the cutting mechanism is assembled, the abutment surfaces on said support stays contact the abutment surfaces on said fingers and support said fingers.

7. A knife shaft stripping device according to claim 6, wherein said abutment surfaces are disposed at an acute angle to one another.

8. A knife shaft stripping device according to claim 6, wherein said abutment surfaces are disposed at an obtuse angle to one another.

9. A knife shaft stripping device according to claim 1, wherein said stripping fingers and said support stays, bearing surfaces for said knife shafts, a motor mount, and mounting surfaces for a transmission are injection molded in said housing top and bottom.

* * * * *